US005752475A

United States Patent [19]

Mazzella et al.

[11] Patent Number: 5,752,475

[45] Date of Patent: May 19, 1998

[54] VEE-TYPE, CAM-IN-BLOCK INTERNAL COMBUSTION ENGINE

[75] Inventors: Richard Salvatore Mazzella, Eastpointe; Michael Joseph Schrader, Belleville, both of Mich.

[73] Assignee: Ford Global Technologies, Inc., Dearborn, Mich.

[21] Appl. No.: 679,918

[22] Filed: Jul. 15, 1996

[51] Int. Cl.[6] ..... F02B 75/22

[52] U.S. Cl. ..... 123/54.4

[58] Field of Search ..... 123/54.4, 54.5, 123/54.6, 54.7, 54.8, 195 R, 195 H

[56] References Cited

U.S. PATENT DOCUMENTS

| | | | |
|---|---|---|---|
| 2,743,712 | 7/1956 | Hulsing . | |
| 2,906,252 | 9/1959 | Beardsley . | |
| 2,985,148 | 5/1961 | Caris | 123/54.4 |
| 2,990,819 | 7/1961 | Bouvy | 123/54.4 |
| 3,034,488 | 5/1962 | Reiners . | |
| 4,054,108 | 10/1977 | Gill | 123/54.4 |
| 4,563,986 | 1/1986 | Nakano . | |
| 4,881,496 | 11/1989 | Kronich . | |
| 5,058,542 | 10/1991 | Grayson et al. . | |

FOREIGN PATENT DOCUMENTS

| | | |
|---|---|---|
| 5-118249 | 5/1993 | Japan . |
| 992759 | 1/1983 | U.S.S.R. . |
| 604850 | 7/1948 | United Kingdom . |
| 850129 | 9/1960 | United Kingdom . |

*Primary Examiner*—Marguerite McMahon
*Attorney, Agent, or Firm*—Jerome R. Drouillard

[57] ABSTRACT

An internal combustion engine with a single camshaft and a vee type configuration has an external bulkhead extending between the banks of cylinders. The bulkhead is supported by ribs extending vertically and generally laterally between the cylinder banks.

5 Claims, 4 Drawing Sheets

VEE-TYPE, CAM-IN-BLOCK INTERNAL COMBUSTION ENGINE

BACKGROUND OF THE INVENTION

1. Field of the Invention

The present invention relates to an internal combustion engine having a cylinder block which provides superior noise reduction and strength characteristics in a vee-type, cam-in-block configuration.

2. Disclosure Information

Vee-type engines having a single camshaft ("cam") located between the banks of cylinders within the cylinder block typically utilize bolted cylinder heads which attach to cylinder head mounting surfaces machined on the cylinder block. Of course, with the camshaft mounted between the cylinders, it is necessary that rocker arms and pushrods be used for the purpose of actuating the cylinder valves. This is accomplished by bringing pushrods up from a series of valve tappets which are actuated by lobes formed on the camshaft. The pushrods are interposed between valve tappets and rocker arms mounted to the cylinder head. Lubrication must be provided at the interfaces between the tappets and camshaft as well as the interfaces between the pushrods and the tappets and rocker arms. In many engines, the interface between the camshaft and tappets is lubricated by oil slung from the crankshaft and connecting rods upon the cam lobes. Some form of sealing is needed to prevent the oil from being thrown clear of the engine, or upon inappropriate parts, such as an intake manifold. Impingement of hot oil upon the underside of an intake manifold is generally undesirable because it may result in heating of the air charge, accompanied by a degradation in engine performance due to a reduction in the mass of air inducted into the cylinders.

Another problem with prior art vee-type engines having camshafts located in the cylinder block is related to a structural weakness in the cylinder block itself. Cylinder heads typically are equipped with intake manifold mounting flanges which have faces which are generally parallel to the centerlines of the engine cylinders of the bank adjoining the flanges in question. This means that the intake manifold must be wedged into place between the two cylinder heads of the engine. As a result, the cylinder block is distorted. Thus, it is desirable and the inventors have found a structure for mitigating this distortion problem. In the first case, the inventors' external bulkhead provides a strengthening structure for bridging across the cylinder block between the banks of cylinders. In the second case, the external bulkhead provides a robust structure for sealing the top of the engine to prevent undesirable leakage of lubricating oil from the crankcase to either external portions of the engine or to the environment.

SUMMARY OF THE INVENTION

An internal combustion engine having banks of cylinders arranged in a vee-type configuration includes a cylinder block having two banks of cylinder bores with an included angle therebetween in the range of 60°–90°. The cylinder block further includes a plurality of camshaft support bearings disposed in bulkheads extending laterally between the banks of cylinders and an external bulkhead positioned above the camshaft support bearings and extending laterally between the cylinder bores and longitudinally between the front and rear faces of the block. The external bulkhead incorporates a pair of tappet galleries with one gallery disposed adjacent each bank of cylinder bores. An interior wall of each gallery comprises a portion of a mounting surface for accepting a cylinder head. A pair of cylinder heads is attached to the engine, with one cylinder head being attached to each of the cylinder head mounting surfaces, and with each of the cylinder heads serving as an upper closure for one of the tappet galleries. A single camshaft for operating poppet valves located in the cylinder heads is mounted within the cylinder block upon the camshaft support bearings.

Each of the cylinder heads, according to the present invention, has an intake manifold mounting flange extending inwardly from the plan view location of the tappet galleries in the cylinder block, with the intake manifold mounting flanges lying in a common plane. Additional strength is provided for the external bulkhead by means of a plurality of supporting ribs extending generally laterally between tappet bores bosses associated with opposing cylinders, with each support rib extending vertically from the roof of the external bulkhead to a location above the camshaft.

A plurality of tappets is housed within a plurality of bores formed in the tappet galleries, with each of the tappets being positioned between one lobe contained on the camshaft and one end of a pushrod extending into one of the cylinder heads.

It is an advantage of the present invention that an engine built according to this invention will have a low noise signature because of added strength and stiffness provided by applicants' inventive external bulkhead.

It is another advantage of the present invention that the intake manifold mounting location prevents wedging of the block and provides superior useful life and lower engine operating friction.

Other advantages as well as objects and features of the present invention will become apparent to the reader of this specification.

DETAILED DESCRIPTION OF PREFERRED EMBODIMENTS

Figure 1:
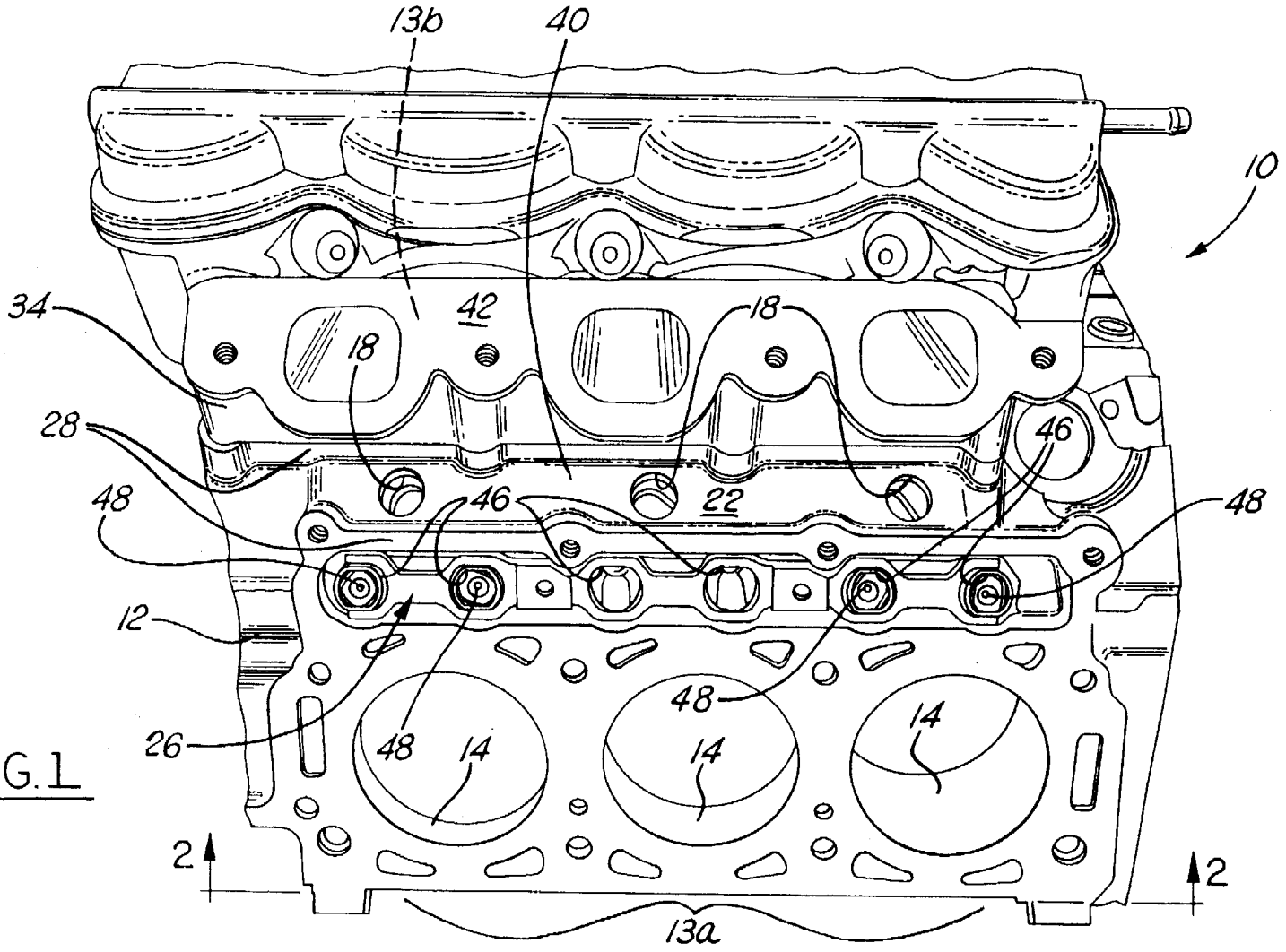
FIG. 1 is a perspective view of an engine block according to the present invention having only one of two cylinder heads mounted thereon.
Figure 2:
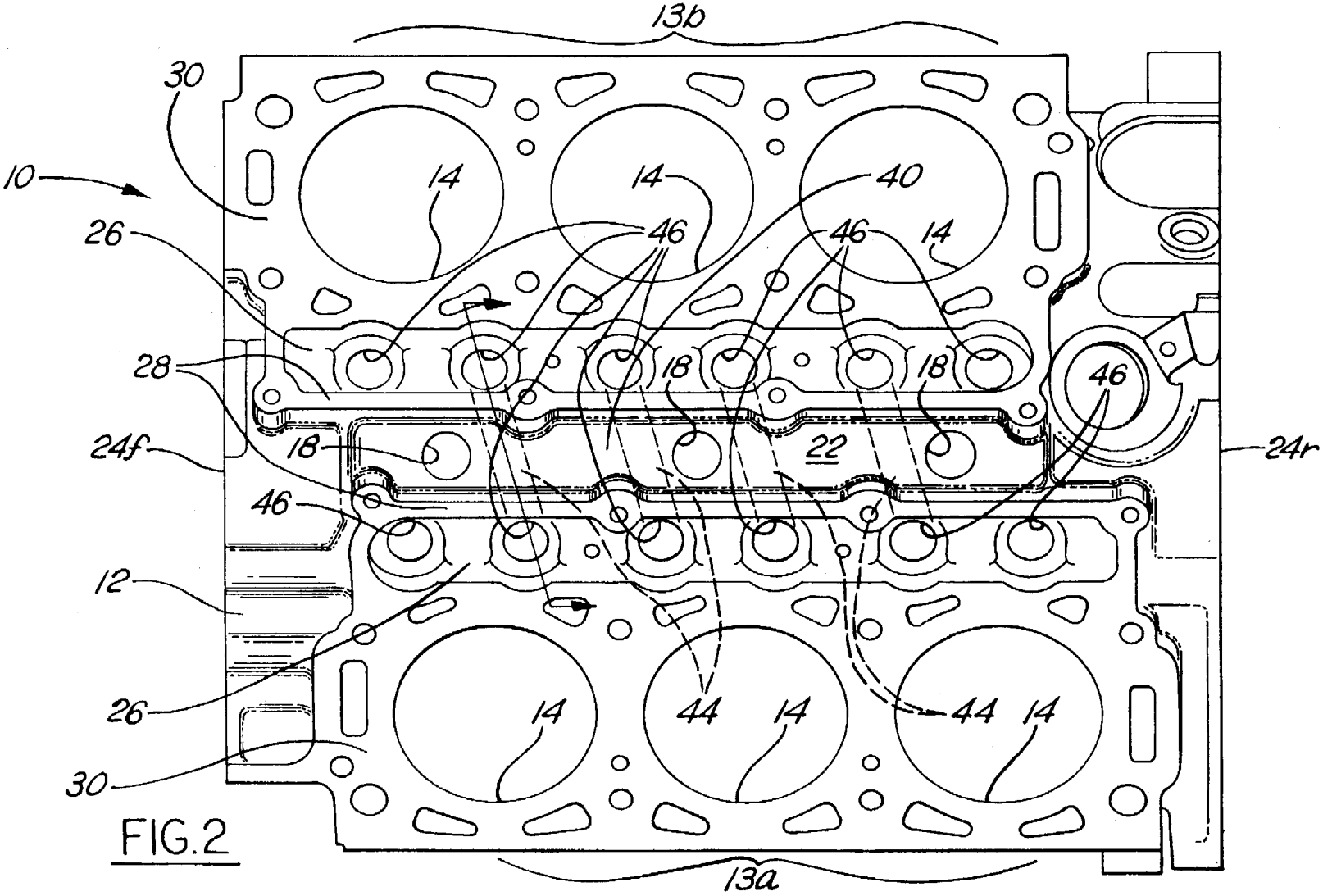
FIG. 2 is a plan view of the engine block of FIG. 1 having neither cylinder head mounted thereon.
Figure 3:
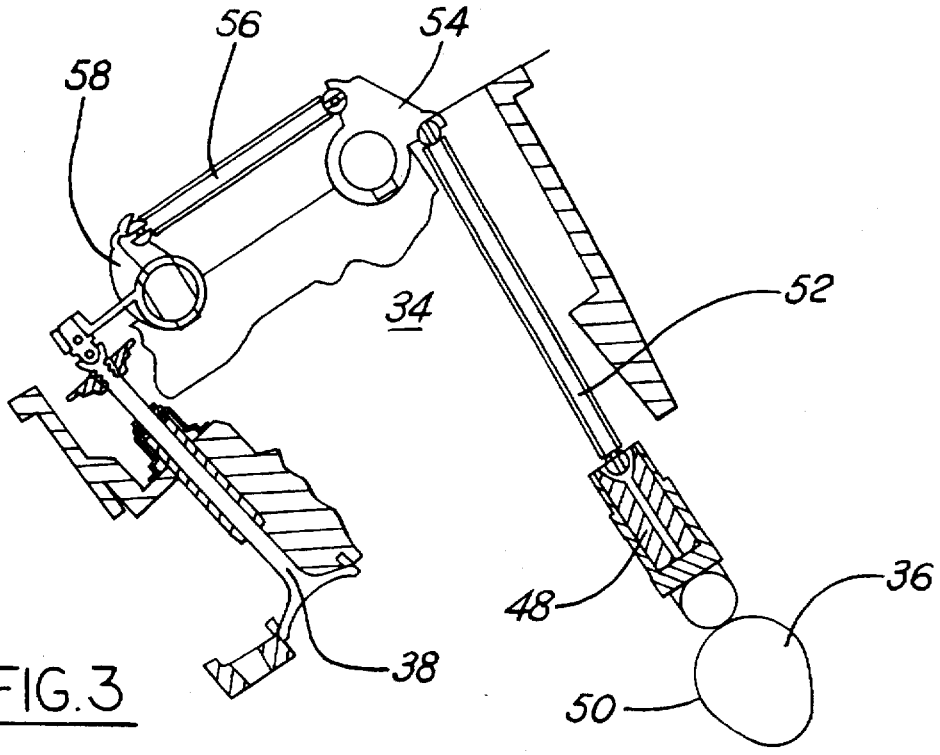
FIG. 3 is partially schematic representation of a sectional view taken vertically through a portion of the engine of FIG. 1, showing the cylinder head and valve train.

As shown in FIGS. 1 and 2, internal combustion engine 10 has two cylinder banks 13*a* and 13*b*, with the cylinders arranged in a vee-type configuration. The included angle between the banks of cylinder bores is in the range of 60°–90°. The present engine is of the cam-in-block variety, and, as shown in FIG. 3, camshaft 36, which is the single and exclusive camshaft used in this engine, is situated so as to operate the valve gear of the engine. Accordingly, cam 36, having a plurality of lobes 50, actuates a plurality of tappets 48. The reciprocating tappets, in turn, bear upon primary pushrods 52, which actuate primary rocker arms 54. Intermediate pushrods 56 are interposed between primary rocker arms and secondary rocker arms 58. Poppet valves 38 are then reciprocated by secondary rocker arms 58. Those skilled in the art will appreciate in view of this disclosure that an engine need not have the precise valve gear shown in FIG. 3; the present invention is equally applicable to rocker arm equipped engines which do not have intermediate pushrods 56 and secondary rocker arms 58.

Figure 4:
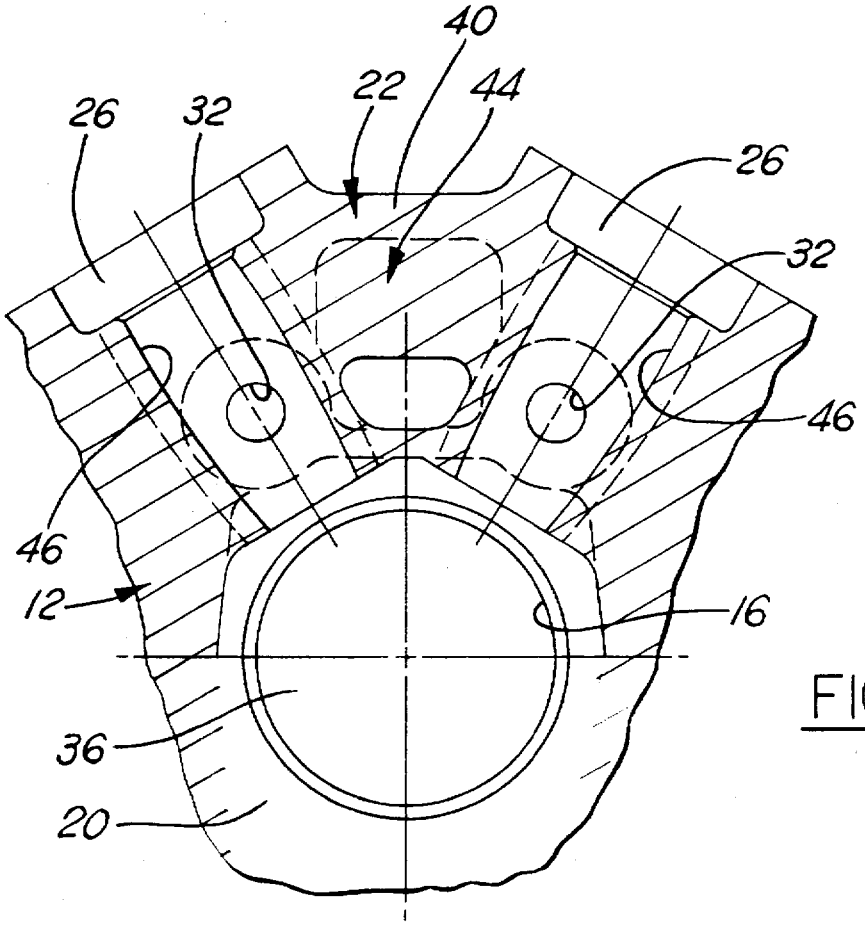
FIG. 4 is a partial sectional view taken along the line 4—4 of FIG. 2.

As shown in FIG. 4, camshaft 36 is mounted within camshaft support bearing 16. More specifically, a plurality of camshaft support bearings 16 are disposed in camshaft bulkheads 20, which extend laterally across the engine block between adjacent banks of cylinders.

The present inventors have discovered that an engine according to the present invention provides superior noise control while avoiding excessive cylinder bore distortion. This is accomplished in the main by means of external bulkhead 22, which is shown in partial section in FIG. 4. External bulkhead 22 comprises roof portion 40 which extends laterally between banks of cylinders 13*a* and 13*b*. Roof portion 40 incorporates a pair of tappet galleries 26, with one gallery 26 disposed adjacent each bank of cylinder bores (FIGS. 1 and 2). Each tappet gallery 26 has an interior wall 28 which comprises a portion of mounting surface 30 for accepting one of cylinder heads 34. As noted above, extending the mounting plane, on each side of the engine, of cylinder heads 34 from a position outboard of cylinder bores 14, in normal fashion, to a position moved considerably inboard on the engine, i.e., to the interior wall 28 of a tappet gallery 26, permits greatly enhanced structural integrity of cylinder block 12.

External bulkhead 22 of the present invention importantly includes a plurality of support ribs 44 which, as shown in FIGS. 2 and 4, extend generally laterally between the circular bosses of tappet bores 46 associated with opposing cylinders located in alternate banks. Each support rib extends vertically from roof portion 40 of external bulkhead 22 to a location above camshaft 36. Because the support ribs are tied into the bosses of tappet bores 46, which themselves comprise a structure having considerable strength and rigidity, the effect of the present external bulkhead 22 is to greatly enhance the resistance of the block to bending in planes perpendicular to the longitudinal axis of the crankshaft.

Figure 5:
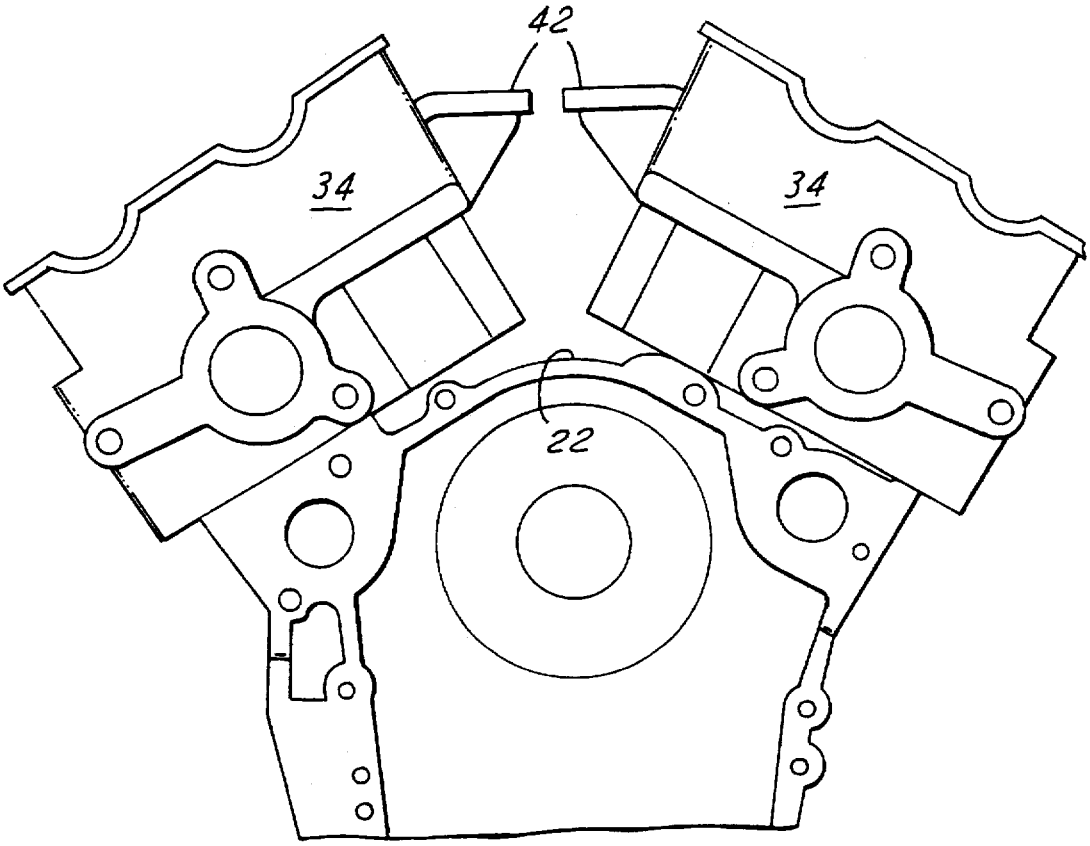
FIG. 5 is an end view of an engine according to the present invention.

As noted above, a pair of cylinder heads 34 is mounted to engine 10 upon cylinder head mounting surfaces 30. Each of cylinder heads 34 serves as an upper closure for one of tappet galleries 26. Each of cylinder heads 34 has an intake manifold mounting flange, 42, incorporated therein. Intake manifold mounting flanges 42 are situated such that when cylinder heads 34 are bolted to the engine, mounting flanges 42 will be parallel and, in effect, lie in a common plane. Flanges 42 extend inwardly from the plan view location of tappet galleries 26. As shown in FIG. 5, because intake manifold mounting flanges 42 lie in a common plane, the bolting of an intake manifold (not shown) to an engine constructed according to the present invention will not promote the bore distortion which is common with vee block engines in which the intake manifold is wedged in place between intake manifold mounting flanges which are not parallel to each other.

Those skilled in the art will appreciate in view of this disclosure that other modifications may be made according to the claims of this invention.

We claim:

1. An internal combustion engine having banks of cylinders arranged in a vee, with said engine comprising:

a cylinder block comprising:

two banks of cylinder bores having an included angle therebetween in the range of 60° to 90°, a plurality of camshaft support bearings disposed in bulkheads extending laterally between the banks of cylinders, and a unitary external bulkhead positioned above said camshaft support bearings and extending laterally between the cylinder bores and longitudinally between the front and rear faces of the block, with said external bulkhead incorporating a pair of tappet galleries, with one gallery disposed adjacent each bank of cylinder bores, and with an interior wall of each gallery comprising a portion of a mounting surface for accepting a cylinder head;

a pair of cylinder heads, with one cylinder head being attached to each of said cylinder head mounting surfaces, with each of said cylinder heads serving as an upper closure for one of said tappet galleries, with each of the cylinder heads having an inwardly extending intake manifold mounting flange, with the intake manifold mounting flanges lying in a common plane; and a single camshaft for operating poppet valves located in the cylinder heads, with said camshaft being mounted within the cylinder block upon said camshaft support bearings.

2. An internal combustion engine according to claim 1, wherein said external bulkhead further comprises a plurality of support ribs extending generally laterally between tappet bores associated with opposing cylinders, with each support rib extending vertically from an upper portion of the external bulkhead to a location above the camshaft.

3. An internal combustion engine according to claim 1, further comprising a plurality of tappets housed within a plurality of bores formed in said tappet galleries, with each of said tappets being positioned between one lobe contained on said camshaft and one end of a pushrod extending into one of said cylinder heads.

4. An internal combustion engine having banks of cylinders arranged in a vee, with said engine comprising:

a cylinder block comprising:

two banks of cylinder bores having an included angle therebetween of 60° to 90°, a plurality of camshaft support bearings disposed in bulkheads extending laterally between the banks of cylinders, and an external bulkhead extending above said camshaft support bearings and laterally between the cylinder bores and longitudinally between the front and rear faces of the block, with said external bulkhead incorporating a pair of tappet galleries, with one gallery disposed inboard from each bank of cylinder bores, with an interior wall of each gallery comprising a portion of a planar mounting surface for accepting a cylinder head, with said external bulkhead further comprising a plurality of support ribs extending generally laterally between tappet bore bosses associated with cylinders in opposite banks, with each support rib extending vertically from an upper portion of the external bulkhead to a location above the camshaft;

a pair of cylinder heads, with one cylinder head being attached to each of said planar mounting surfaces, with each of said cylinder heads serving as an upper closure for one of said tappet galleries, and with each of said cylinder heads having an intake manifold mounting flange extending laterally inwardly, such that the mounting flanges lie in a common plane; and a single camshaft for operating poppet valves located in both cylinder heads, with said camshaft being mounted within the cylinder block upon said camshaft support bearings.

5. An internal combustion engine according to claim 4, further comprising a plurality of tappets housed within a plurality of bores formed in said tappet galleries, with each of said tappets being positioned between one of a plurality of lobes contained on said camshaft and one end of a plurality of pushrods extending into said cylinder heads.

* * * * *